US010195718B2

(12) United States Patent
Ficai

(10) Patent No.: US 10,195,718 B2
(45) Date of Patent: Feb. 5, 2019

(54) GRINDING WHEEL

(71) Applicant: Paolo Ficai, Parma (IT)

(72) Inventor: Paolo Ficai, Parma (IT)

( * ) Notice: Subject to any disclaimer, the term of this patent is extended or adjusted under 35 U.S.C. 154(b) by 155 days.

(21) Appl. No.: 15/218,381

(22) Filed: Jul. 25, 2016

(65) Prior Publication Data

US 2017/0274502 A1 Sep. 28, 2017

(30) Foreign Application Priority Data

Mar. 25, 2016 (IT) ..... 102016000031648

(51) Int. Cl.

| | |
|---|---|
| ***B24D 5/14*** | (2006.01) |
| ***B24D 5/04*** | (2006.01) |
| ***B24D 7/04*** | (2006.01) |
| *B24D 11/04* | (2006.01) |

(52) U.S. Cl.

CPC ..... *B24D 5/14* (2013.01); *B24D 5/04* (2013.01); *B24D 7/04* (2013.01); *B24D 11/04* (2013.01)

(58) Field of Classification Search

CPC ... B24D 3/22; B24D 5/04; B24D 5/14; B24D 7/04

See application file for complete search history.

(56) References Cited

U.S. PATENT DOCUMENTS

| | | | | |
|---|---|---|---|---|
| 2,070,764 A * | 2/1937 | Webster | B24D 7/04 | 451/548 |
| 3,889,430 A * | 6/1975 | Scandaletos | B24D 5/04 | 451/546 |
| 4,048,765 A | 9/1977 | Samuelson | | |
| 4,615,151 A | 10/1986 | Huber et al. | | |
| 5,092,082 A | 3/1992 | Padberg et al. | | |
| 5,669,941 A * | 9/1997 | Peterson | B24D 3/28 | 51/295 |
| 9,700,992 B2 * | 7/2017 | Ficai | B24D 5/04 | |
| 2015/0000206 A1 * | 1/2015 | Klett | B24D 3/28 | 51/298 |
| 2015/0196992 A1 * | 7/2015 | Ficai | B24D 5/04 | 451/544 |

FOREIGN PATENT DOCUMENTS

| | | |
|---|---|---|
| DE | 2610580 A1 | 9/1977 |
| DE | 3442230 A1 | 5/1986 |
| EP | 2896482 A2 | 7/2015 |

OTHER PUBLICATIONS

Italian search report, dated Jan. 18, 2017. In corresponding application No. ITUA20162031.

European Extended Search Report for corresponding European Application No. EP17160384.

* cited by examiner

*Primary Examiner* — Timothy V Eley

(74) *Attorney, Agent, or Firm* — Browdy and Neimark, PLLC

(57) ABSTRACT

An abrasive grinding wheel (20) comprising an annular body (200) defining an abrasive front face (202) at least partly made of a layer of an abrasive mixture (21) and an opposite rear face (203), which grinding wheel (20) comprises an annular damping element (23) made of a resilient yielding material and fixed to the annular body (200), wherein the damping element (23) comprises a first face (231) facing towards the abrasive front face (202) and an opposite free second face (232) which defines at least a portion of the rear face (203) of the annular body (200).

10 Claims, 6 Drawing Sheets

GRINDING WHEEL

TECHNICAL FIELD

The present invention relates to an abrasive grinding wheel, having a depressed centre or flat, for grinding or cutting.

PRIOR ART

As is known, many grinding wheels exist, of a disc-shaped type with a depressed centre or flat, conical, semi-flexible or rigid, particularly used on portable high-speed electric or compressed-air grinding machines (60-100 m/s peripheral velocity), also known as sanding machines, for carrying out deburring and/or cutting operations. These grinding wheels are essentially constituted by an abrasive mixture reinforced by armatures constituted by one or more textile nets, one or two annular metal elements, commonly known as washers or ferrules, which delimit the fixing hole of the grinding wheel to the shaft of the grinding machine, and possibly by a paper label or identifier commonly used, adhering to one of the two faces of the grinding wheel (usually to the convex face).

The abrasive mixture is, generally, constituted by grains of abrasive material (light green, dark green, black silicon carbide, corundum, zircon-modified corundums, friables, brown, white, pink, ruby, ceramic, monocrystallines, sol-gel abrasives or sintered ceramics or others) of predefined grain size (normally measured in mesh) which are mixed with resins, for example phenolic, liquid and/or powder-form, and possibly modified with epoxy resins, and/or others, possibly modified with organic and/or vegetable or synthetic compounds, and other types of polyimide resins etc., and with additives and fillers.

The hardness of the abrasive grinding wheel is defined on the basis of the percentage of resin in the mixture, in particular the larger the percentage in weight of the abrasive of the resin, the greater the hardness of the abrasive grinding wheel.

The reinforcing nets are normally woven with glass fibre yarns, but other types of fibres might also be used, such as carbon, Kevlar or others; woven nets in the order of 1.5 meters in height are first immersed in a liquid resin and solvent solution, wrung between pairs of rollers and dried in appropriate kilns internally of which the resin dries without polymerising (polymerisation is completed subsequently in the firing kiln together with the firing of the grinding wheel).

The nets needed for reinforcing the grinding wheels are fashioned from the textile net, impregnated with resin and dried as described above, by punching or another cutting method.

The nets can possibly be pre-glued to a paper or polymer sheet having a fine thickness, which might also be the labels.

The annular elements which delimit the mounting hole of the grinding wheel are constituted by a circular crown plate, or another shape, such as for example square or polygonal, from the internal hole of which a hollow cylindrical or not-cylindrical appendage extends; the plate adheres to one of the two faces of the grinding wheel, while the hollow appendage inserts in the hole of the grinding wheel, delimiting the internal wall thereof.

The labels are made of paper or tin or another synthetic material and are normally shaped as a circular crown (but can however be of any shape), and can occupy either all the face of the grinding wheel or a limited area of the face to which they adhere, and display the identifying data of and information relating to the grinding wheel.

Abrasive grinding wheels are produced by pressing in dies constituted by a ring in which an open forming cavity is housed, known as the female die, and by a complementary punch, known as the male die.

The pressed unformed abrasive grinding wheel (green) is then subjected to slowly rising heating from 80° C. to 125° C.; in these conditions the resins of the abrasive mixture and the resins that impregnate the reinforcement net or nets become fluid and fuse together to mutually co-penetrate; in this way the abrasive mixture adheres to the net or nets and together with them creates a single block.

The subsequent heating up to 180°-190° C. (but even lower) determines the irreversible polymerisation process of the resin.

High-performing (in terms of removal of material) abrasive grinding wheels generally have abrasive grains that are particularly tenacious and large and a high weight percentage of resin.

A drawback encountered in these high-performance abrasive grinding wheels lies in the fact that these grinding wheels have a very rigid structure, lacking in any kind of flexibility, a fact which, taken in combination with the high rotation velocity imparted by the work tool and the shape and balancing imperfections, leads to transmission of annoying vibrations that are damaging and fatiguing to the upper limbs of the user.

An aim of the present invention is to obviate the above-mentioned drawbacks of the prior art, with a solution that is simple, rational and relatively very inexpensive. The aims are attained by the characteristics of the invention as reported in the independent claim. The dependent claims delineate preferred and/or particularly advantageous aspects of the invention.

DESCRIPTION OF THE INVENTION

The invention in particular relates to an abrasive grinding wheel comprising an annular body having an abrasive front face at least partly made of a layer of an abrasive mixture and an opposite rear face, which grinding wheel comprises an annular damping element made of a resilient yielding material and (fixed to) incorporated in the annular body, wherein the damping element comprises a first face facing towards the abrasive front face and an opposite free second face which defines at least a portion of the rear face of the annular body.

With this solution, the abrasive grinding wheel, irrespective of the hardness of the abrasive mixture and the dimension of the abrasive grains, is able to at least partly damp the vibrations due to the contact between the abrasive grinding wheel and the piece to be machined during use of the grinding wheel itself, with undoubted advantages in terms of comfort for the user, duration of use and abrasive capacity.

In a further aspect of the invention, the resilient yielding material can be rubber, for example a silicone, polyurethane rubber, nitrile rubber, natural rubber, EPDM or another rubber.

Thanks to this aspect, the damping element can easily be manufactured in a very economical and especially effective way and can stably bond with the layer of abrasive material, for example by adhesion by means of the resin contained in the layer of abrasive material and by the resin which impregnates the reinforcing nets.

The resilient yielding material advantageously has an hardness comprised between 10 and 200 Shore.

Preferably but not limitedly, the grinding wheel of the invention may comprise at least a backing net fixed to the second face of the damping element.

With this solution, the layered structure of the grinding wheel can be particularly compact and long-lived.

For example, at least a reinforcing net may be incorporated in the layer of abrasive mixture.

In a further aspect of the invention, the thickness of the damping element may be comprised between 0.2 and 3 mm, preferably may be equal to 1 mm.

With this solution, the damping effect of the vibrations, compatibly with a smaller axial volume, can be maximised.

In a further aspect of the invention, the damping element may have an external diameter that is preferably larger than or equal to 30 mm, for example larger than or equal to the external diameter of the mounting flanges for locking the abrasive grinding wheel.

With this solution, the damping element can have a diameter comparable (greater than or equal to) the external diameter of the mounting flange which locks the grinding wheel to the drive shaft of the grinding machine, with undoubted advantages in terms of reduction of the transmission of the vibrations from the front face of the grinding wheel towards the grinding machine itself and, therefore, towards the user, as substantially the flange presses on a portion of the grinding wheel, characterised by the presence of the damping element.

In a further aspect of the invention, the damping element has an external diameter substantially smaller than or equal to 0.7 times the external diameter of the annular body, preferably less than or equal to 0.5 times the external diameter of the annular body.

With this solution, an external abrasive circular annulus, which radially surrounds the damping element, however exists, with undoubted advantages in terms of resistance and efficiency of the abrasive grinding wheel. Further, the fact that the damping element exposes the outer peripheral zone of the grinding wheel, the damping element does not affect the abrasive performance of this outer peripheral zone. The presence of non-abrasive material in that zone would in fact negatively affect both the abrasive performance and the resistance of the product.

The damping element can have an internal diameter that is substantially equal to the internal diameter of the annular body.

In a further aspect of the invention, the grinding wheel might comprise at least an auxiliary damping element (or more than one), for example similar to the above-mentioned damping element, which has an annular shape and is coaxially fixed to the annular body; the auxiliary damping element is then axially interposed between the front face of the annular body and the first face of the damping element, in practice being incorporated internally of the annular body, for example at a distance from or in contact with the first face of the damping element.

Further, for the same aims as illustrated in the foregoing, the invention can provide an abrasive grinding wheel that can be claimed also independently from what above described, which comprises an abrasive annular body and at least a damper element made of a resilient yielding material, wherein the damper element is coaxially fixed (permanently) to the annular body, wherein the external diameter of the damping element is smaller than or equal to 0.7 times the external diameter of the annular body, preferably smaller than or equal to 0.5 times the external diameter of the annular body.

The solution is particularly advantageous as it enables manufacturing a damped and abrasive grinding wheel in a single piece, thus reducing production costs.

BRIEF DESCRIPTION OF THE DRAWINGS

Further characteristics and advantages of the invention will emerge from a reading of the following description, provided by way of non-limiting example with the aid of the figures illustrated in the appended tables of drawings.

BEST WAY OF CARRYING OUT THE INVENTION

Figure 1:
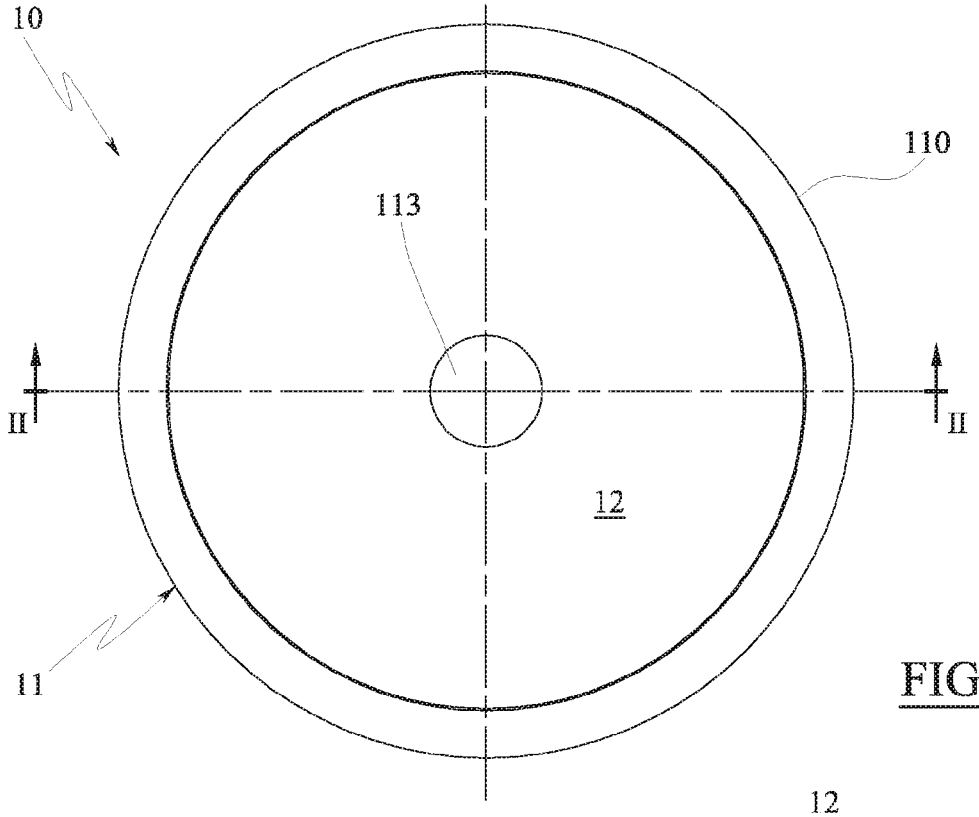
FIG. 1 is a view from above of a forming die of depressed-centre abrasive grinding wheels of the invention.
Figure 2:
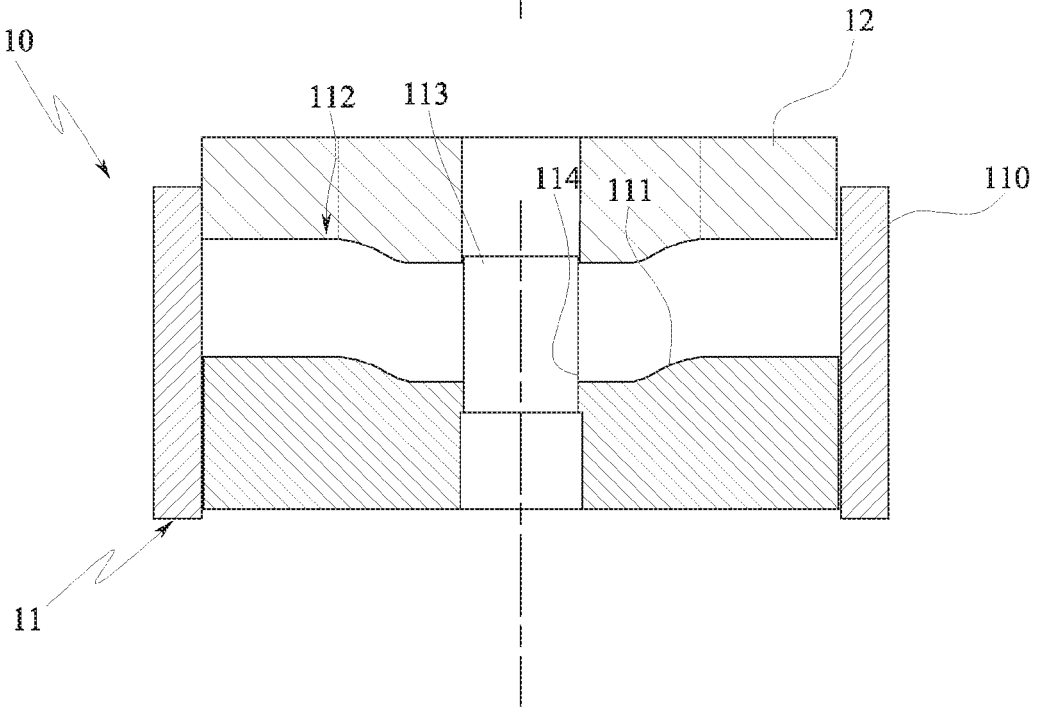
FIG. 2 is a view along section line II-II of FIG. 1.
Figure 3:
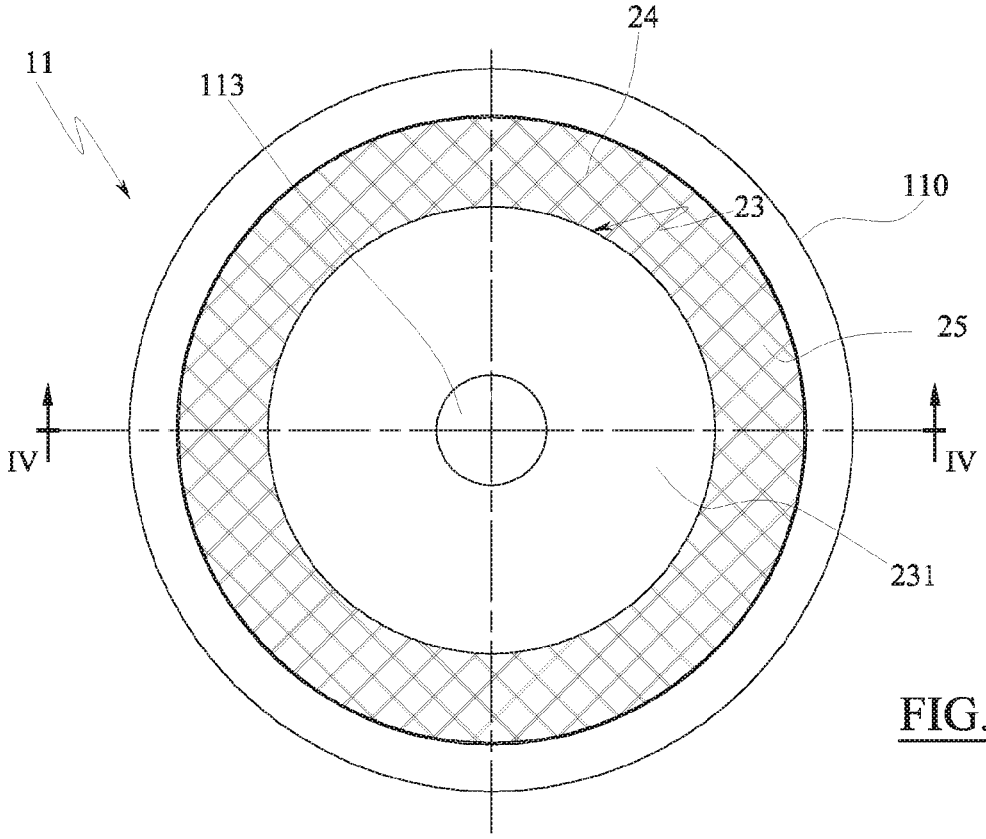
FIG. 3 is a view from above of the die of FIG. 1, wherein the backing net and the damping element have been inserted.
Figure 4:
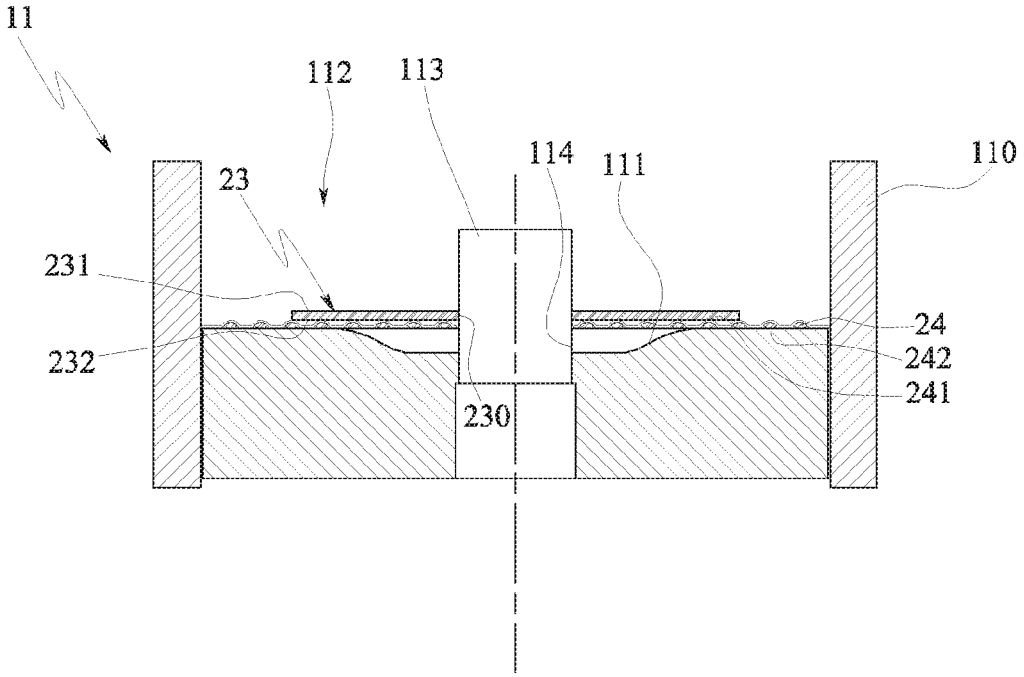
FIG. 4 is a view along section line IV-IV of FIG. 3.
Figure 5:
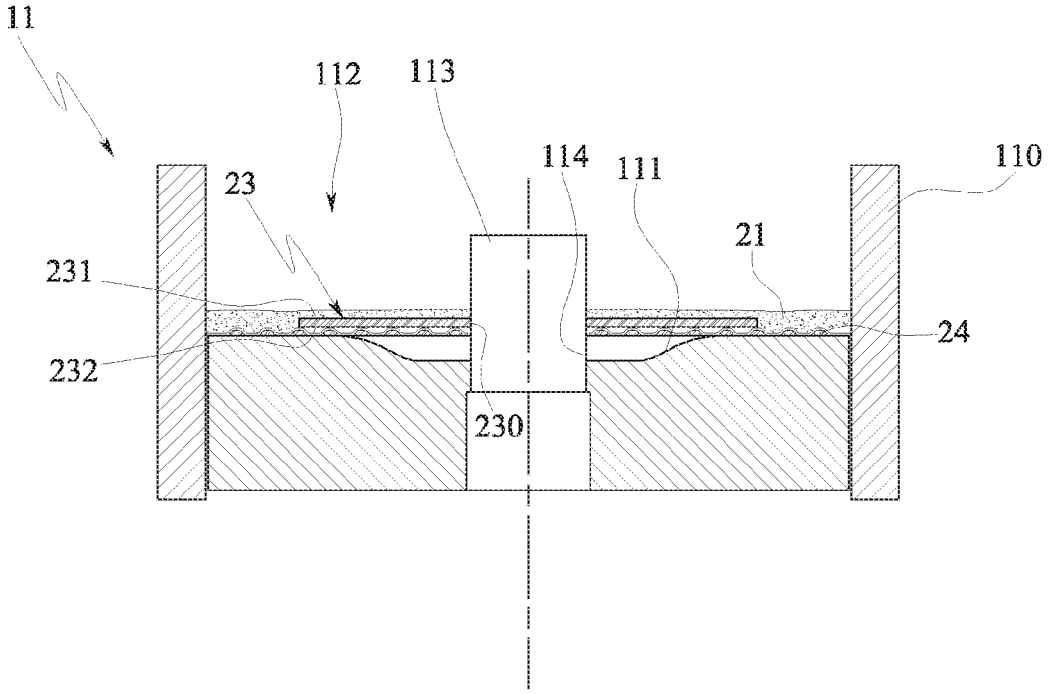
FIG. 5 is a section view of FIG. 4, during the step of depositing a first rear layer of the layer of abrasive mixture.
Figure 6:
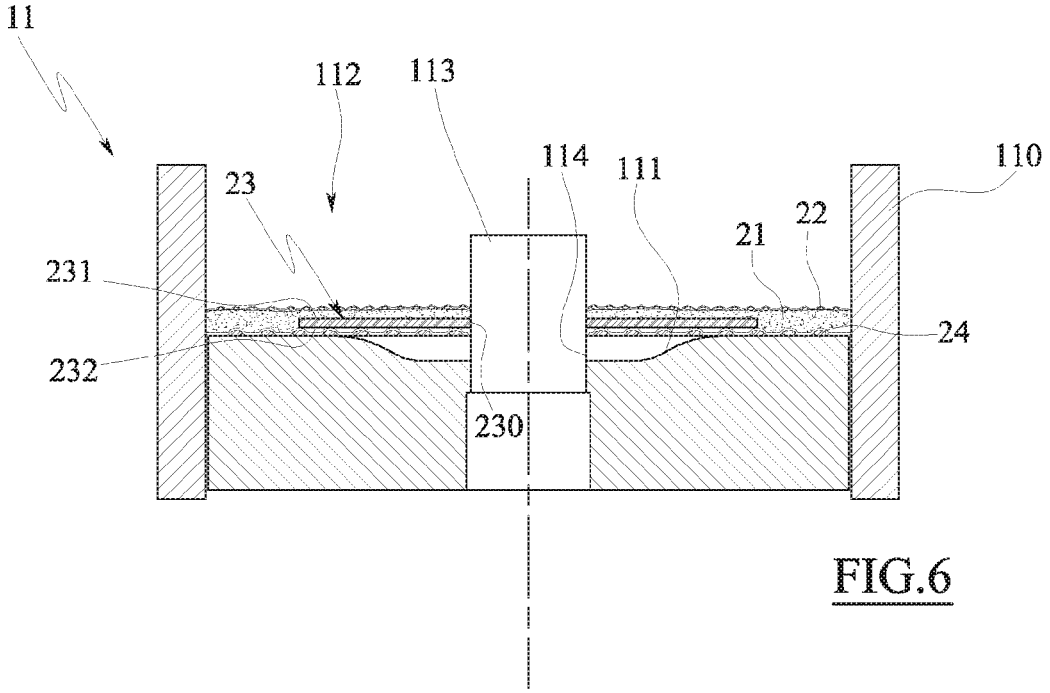
FIG. 6 is a section view of FIG. 5, during a following step in which a reinforcing net is placed resting on the first rear layer of the layer of abrasive mixture.
Figure 7:
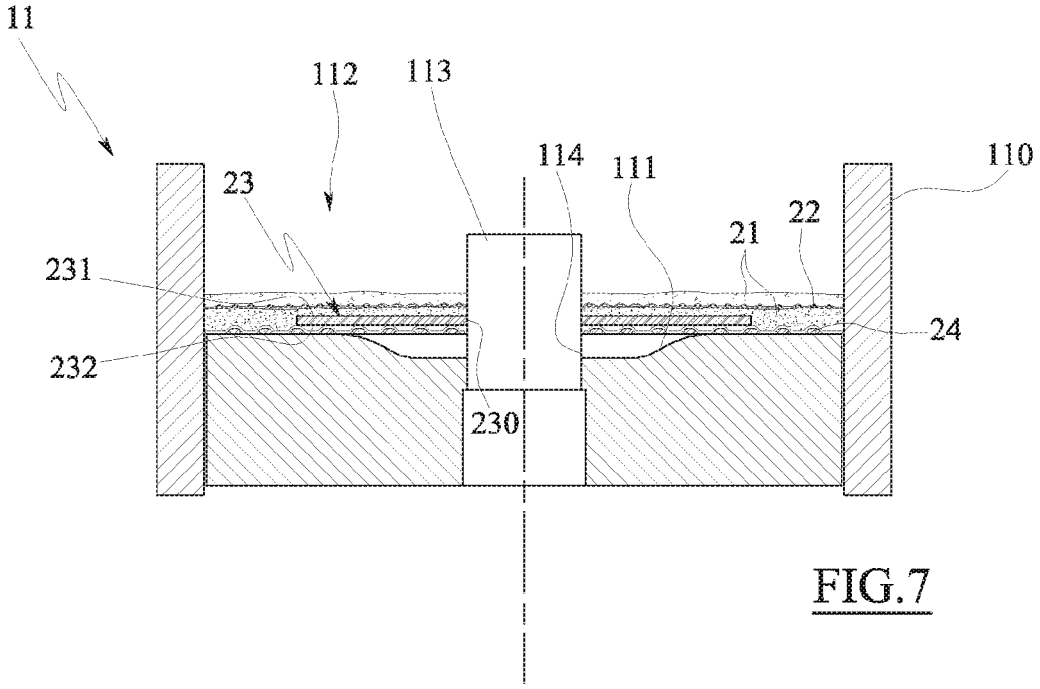
FIG. 7 is a section view of FIG. 6, following a subsequent step in which a second layer of abrasive mixture is deposited.
Figure 8:
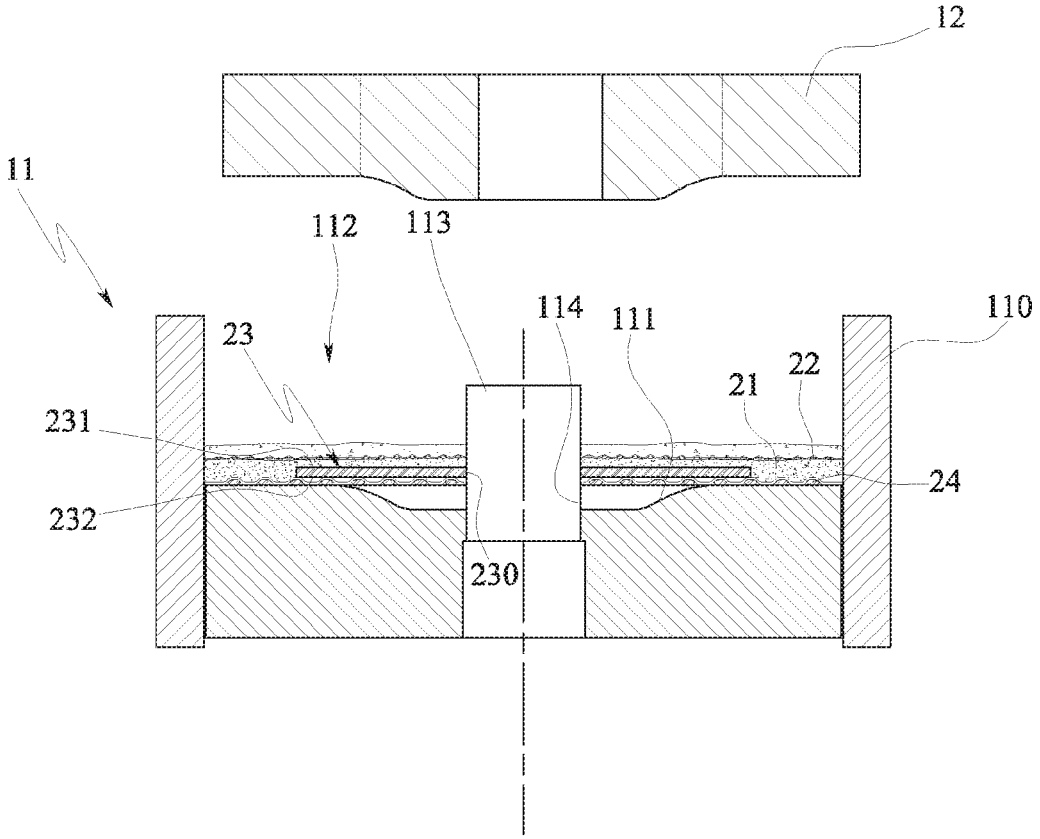
FIG. 8 is a section view of FIG. 7, in a following step preceding the pressing of the abrasive grinding wheel.

With particular reference to the figures, reference numeral 10 overall describes a die for forming abrasive grinding wheels (having a depressed centre or flat/straight or conical or flexible or of another type in accordance with the ISO and EN standards for grinding wheels) overall by the reference numeral 20.

The die 10 comprises a die matrix 11 which opposes a punch 12 for forming the abrasive grinding wheel 20.

The die matrix 11, for example, comprises a cylindrical skirt 110 which is closed in its lower portion by a bottom wall 111.

In practice the bottom wall 111 comprises a disc-shaped body having a circumferential base and for example made of a metal material able, for example to be inserted substantially snugly internally of the cylindrical skirt 110.

The bottom wall 111 and the cylindrical skirt 110 delimit an open-top forming chamber 112.

The bottom wall 111 is advantageously slidably associated with respect to the cylindrical skirt 110 so as to be able to vary the internal volume of the forming chamber 112, in practice varying the axial position of the bottom wall 111 with respect to the cylindrical skirt 110.

The bottom wall 111 is provided with a centring pin 113 located at a centre thereof, rising from the upper face thereof and coaxial with the cylindrical skirt 110.

The centring pin 113, in particular, is inserted in a central hole 114 realised in the bottom wall 111 and fixed therein.

The upper face of the bottom wall 111 can be substantially planar when forming a flat or straight abrasive grinding wheel 20 (or when forming a semi-finished flat grinding wheel which will then be deformed for forming a depressed-centre abrasive grinding wheel 20).

The upper face of the bottom wall 111 preferably comprises a central depression that is coaxial to the same bottom wall, wherein the central depression configures a central dip, so as to overall configure a concave bottom wall 111 for forming depressed-centre abrasive grinding wheels 20.

In any case the bottom wall 111 defines a rest plane for the abrasive grinding wheel 20 to be formed substantially perpendicularly to the axis of the cylindrical skirt 110.

The punch 12, for example, comprises an annular/disc-shaped body the external diameter of which is substantially equal to the external diameter of the bottom wall 111 of the die matrix 11 (i.e. a little smaller than the internal diameter of the cylindrical skirt 110), so as to be suitable to be substantially fit inserted in the cylindrical skirt 110 and be superposed on the bottom wall.

If a depressed-centre abrasive grinding wheel 20 is to be formed, the punch 12 is complementary in shape to the bottom wall 111.

Further, in this embodiment the punch 12 can be made in a single body or by two coaxial and separate annular bodies able to be axially moved independently for the independent formation of the external and internal periphery of the abrasive grinding wheel 20.

The punch 12 and the bottom wall 111 are mobile in reciprocal nearing/distancing, respectively for closing/opening the forming chamber 112, as is known to the skilled person in the art.

The grinding wheel 20 comprises an annular body 200 (planar or preferably having a depressed centre) provided with a central (coaxial) mounting hole 201.

The mounting hole 201 is, substantially coaxially, associable to the free end of a rotating shaft of a grinding machine.

The annular body 200 comprises an abrasive front face 202 (substantially perpendicular to the axis of the grinding wheel 20) and an opposite rear face 203 (parallel to the front face 202).

The front face 202 faces towards the free end of the rotating shaft of the grinding machine, when the grinding wheel 20 is fixed to the rotating shaft (i.e. the mounting hole 201 is fit thereon), the rear face 203 faces towards the grinding machine.

In depressed-centre grinding wheels, in particular, the front face 202 is substantially concave (or has at least a concave central portion) and the rear face 203 is substantially convex (or has at least a central convex portion).

The annular body 200 has a substantially layered structure and is provided with at least a layer of abrasive mixture 21.

The layer of abrasive mixture 21 (once pressed and fired) defines a substantially monolithic body, which has a first face 211 facing towards the front face 202 of the annular body 200, which in practice coincides with and defines the front face 202 of the same annular body, and an opposite second face 212 (substantially parallel to the first face 211).

The layer of abrasive mixture 21 is made of a mixture of abrasive grains that are compacted and stably bonded by a bonding resin.

In practice, the layer of abrasive mixture is obtained by pressing a loose mixture of abrasive material, for example natural corundum, sand, artificial recycled corundum or the like, sol-gel abrasives or sintered ceramics, zircon corundum, or others, and mixed with an appropriate bonding agent for instance based on bonding resins, such as for example, phenolic, liquid and/or powder resins, and possibly modified with epoxy resins, phenoxy resins and/or others, modified with organic and/or vegetable or synthetic compounds, and other types of polyimide resins etc., and with additives and fillers.

For example, the quantity of resin is comprised between 10% and 30% in weight with respect to the weight of the abrasive material powder mixture.

The abrasive material of the layer of abrasive material 21 has a grain size substantially comprised between 120 and 12 mesh (abrasive mixture could however be used having a larger grain size or a lower grain size than the above mentioned range, according to requirements).

For example, the layer of abrasive mixture 21 has a grain size of the abrasive material that is variable along the thickness of the annular body 200.

For example, the grain size of the abrasive material of a front surface layer, which includes and defines the first face 211 of the layer of abrasive mixture 21 (and therefore the front face 202 of the annular body 200), is substantially smaller than 30 mesh, for example comprised 30 and 12 mesh.

The annular body 200 comprises at least a reinforcing net 22 substantially incorporated in the layer of abrasive mixture 21 (for example interposed between the front surface layer and a rear or sub-surface layer, which might have a grain size that is different to the front surface layer).

In practice, the first abrasive mixture layer 21 surrounds, in particular axially surrounds, the whole surface (upper and lower) of the reinforcing net 22.

The layer of abrasive mixture 21 may incorporates more than one reinforcing net 22.

The grinding wheel 20 comprises, in particular, a damping element 23, made of a resilient yielding material, which is fixed to the annular body 200.

For example, the damping element 23 has an annular shape and comprises a through-hole 230 (for example a circular through-hole), for instance substantially central and coaxial to the grinding wheel 20.

The damping element 23 comprises a first face 231 (substantially planar or concave) facing towards the abrasive front face 202 abrasive of the annular body 200 and an opposite (and parallel) second face 232 (substantially planar or convex), which for example faces, in use, towards the grinding machine.

The first face 231 of the damping element 23 is fixed to the layer of abrasive mixture 21, for example to the second face 212 thereof.

In practice, the second face 212 of the layer of abrasive mixture 21 adheres to the whole surface of the first face 231 of the damping element 23.

The second face 232 is substantially free (flush with the rear face 203 of the grinding wheel 20) and defines (or constitutes) at least a portion of the rear face 203 of the annular body 200.

The resilient yielding material the damping element 23 is made of is, for example, rubber.

The rubber is preferably a natural rubber, polyurethane rubber, EPDM or nitrile rubber (NBR).

For example, the first face 231 and/or the second face 232 (and/or the external perimeter edge thereof) of the damping element 23 can be treated or clad with an appropriate primer for promoting the adhesion.

The resilient yielding material advantageously has a hardness comprised between 10 and 200 Shore.

The thickness, namely the axial dimension, of the damping element 23 can be smaller than or equal to the thickness of the annular body 200, i.e. the overall thickness of the grinding wheel 20, for example smaller than or equal to the thickness of the layer of abrasive mixture 21, preferably but not limitedly comprised between 0.2 and 3 mm, preferably equal to 1 mm.

Figure 13:
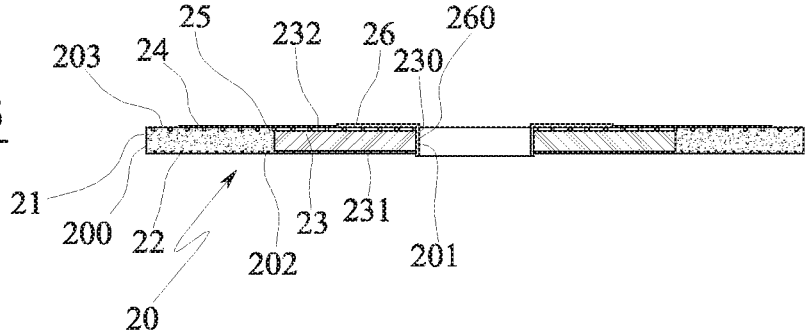
FIG. 13 is a section view of a further embodiment of an abrasive grinding wheel (flat) according to the invention.

In the example shown in FIG. 13, for instance, the thickness of the damping element 23 is substantially equal to the thickness of the annular body 200. The illustrated example shows, for simplicity of representation, a flat grinding wheel 20, but it could also be of the depressed-centre type, or another known type.

For example, the damping element 23 and the annular body 200 are fixed to one another by adhesion (exercised by the resin present in the abrasive mixture and/or by a primer for promoting the adhesion) of the cylindrical external perimeter edge of the damping element and the cylindrical internal perimeter edge of the layer of abrasive mixture 21 which constitutes the annular body 200.

In this case, the annular body 200 is constituted by an annulus radially external of and coaxial to the damping element 23, wherein for example the front face 202 of the annular body 200 is substantially coplanar (or aligned) with the first face 231 of the damping element 23 and the rear face 203 of the annular body 200 is substantially coplanar (or aligned) with the second face 232 of the damping element 23.

The reinforcing net 22, in this example, might be only partly incorporated in the layer of abrasive mixture 21, for example emerging therefrom.

The damping element 23 has an internal diameter, i.e. the diameter of the through-hole 230, substantially equal to (or a little bigger than) the internal diameter of the annular body 200, i.e. the diameter of the mounting hole 201.

The damping element 23 further has an external diameter less than or equal to substantially 0.7 times the external diameter of the annular body 200, preferably less than or equal to 0.5 times the external diameter of the annular body 200.

The damping element 23 preferably has an external diameter substantially larger than 30 mm. The grinding wheel 20 (as shown in FIGS. 1-11 and 13) can also comprise a backing net 24, for example having an annular shape, which comprises a first surface 241 fixed to the damping element 23 and an opposite (and parallel) free second surface 242, which defines at least a portion of the rear face 203 of the annular body 200.

The first surface 241 of the backing net 24 is for instance fixed to the second face 232 of the damping element 23, in such a way that the first surface 241 is at least partly in direct contact with the second face 232 (resting thereon).

The layer of abrasive mixture 21, in a case where the external diameter of the damping element 23 is smaller than the external diameter of the annular body 200 (i.e. of the grinding wheel 20), is arranged to radially border the damping element 23 by means of an annulus having a substantially thickness equal to the thickness of the damping element.

The backing net 24 can have meshes different or equal to the meshes of the reinforcing net, for example wider than the meshes of the reinforcing net 22.

A paper or tin label 25 or another type of label can be positioned on the rear face 203 of the annular body 200 of the grinding wheel 20, namely on the face defined by the second face 232 of the damping element 23 and/or the backing net 24, which label 25 is substantially annular and can occupy the whole rear face 203 of the grinding wheel 20 or a limited radial portion thereof.

Lastly, the grinding wheel 20 comprises one or more metal annular elements, commonly known as washers 26 or ferrules, which delimit the mounting hole 201 of the grinding wheel 20 to the shaft of the grinding machine.

The washer 26 is fixed to the rear face 203 of the grinding wheel 20 (or to the label 25 where included), for example over a limited radial portion of the grinding wheel 20.

The washer 26 comprises a central hollow shank 260 which inserts substantially fit in the mounting hole 201 (and in the through-hole 230 of the damping element 23) and which exhibits an axial thickness that is substantially equal (or a little smaller) than the axial thickness of the grinding wheel 20.

Figure 12:
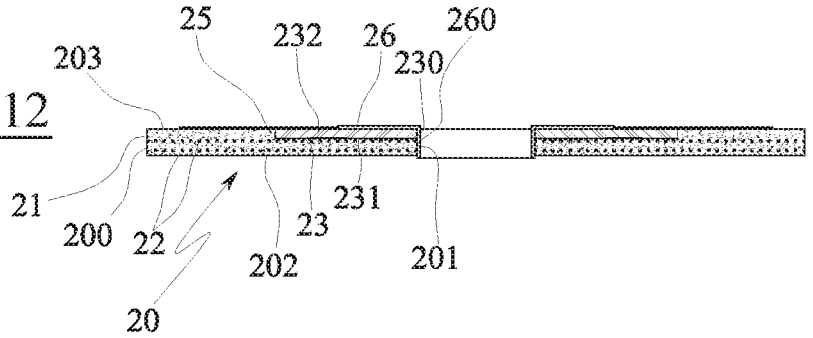
FIG. 12 is a section view of an alternative embodiment of an abrasive grinding wheel (flat) according to the invention.

The grinding wheel 20 (as illustrated in FIG. 12) might be without the backing net 24; in this case the second face 232 of the damping element 23 can be directly in contact with the internal surface of the washer 26 and/or the label 25. The illustrated example shows, in this case too, a flat grinding wheel 20, but it could also be of the depressed-centre type, or another known type.

Figures 9, 10, 11:
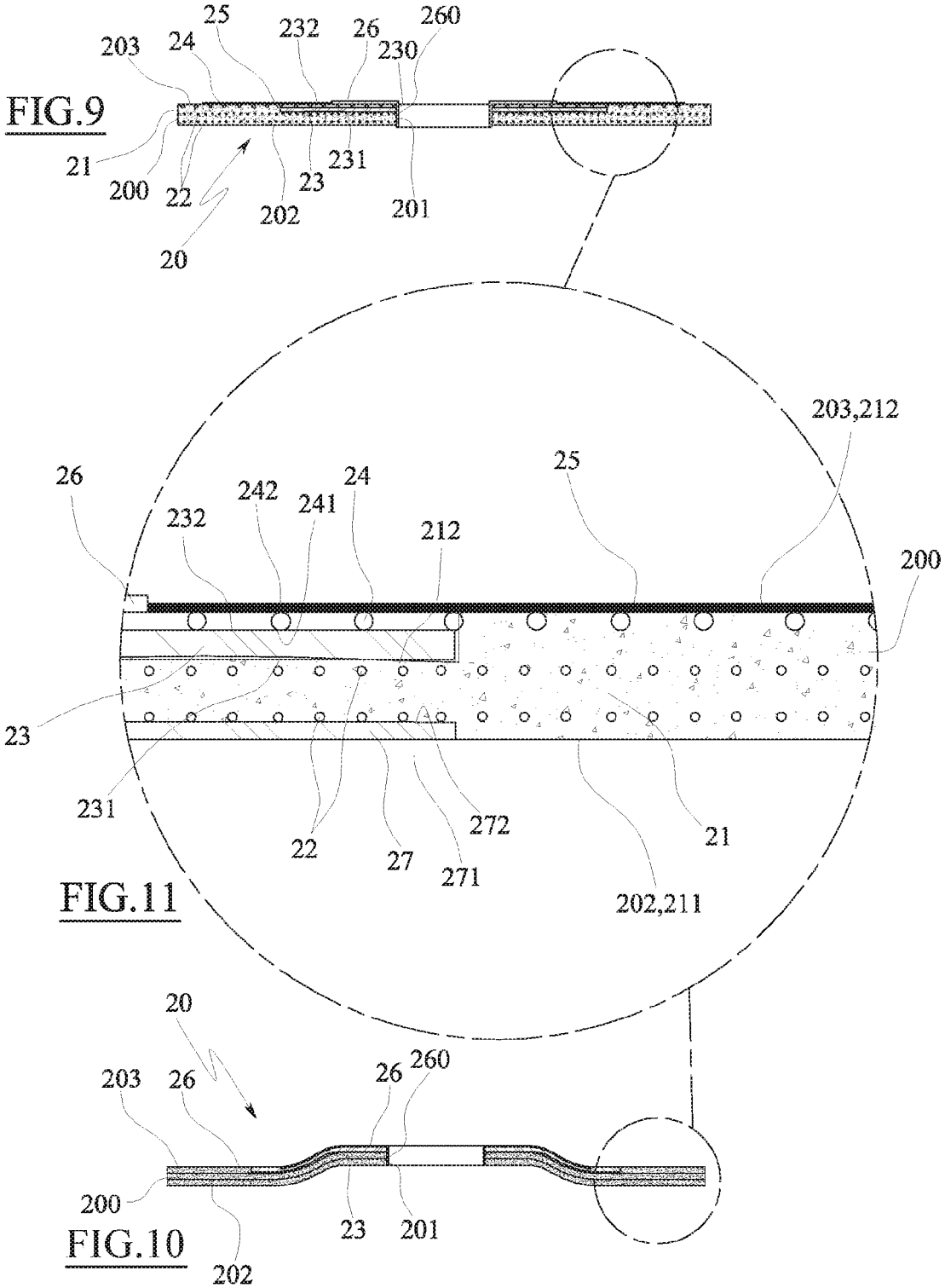
FIG. 9 is a section view of an embodiment of an abrasive grinding wheel according to the invention.
FIG. 10 is a section view of an embodiment of a depressed-centre abrasive grinding wheel according to the invention.
FIG. 11 is a larger-scale view of a detail of FIG. 9 and FIG. 10.

The grinding wheel 20 can further comprise an auxiliary damping element 27, which for example is annular too (wherein the auxiliary damping element 27 is illustrated only in the larger-scale detail of FIG. 11 with a broken line).

The auxiliary damping element 27 is made of a resilient yielding material, and, for example, is coaxially fixed to the annular body 200.

For example, the auxiliary damping element 27 comprises a central through-hole (not illustrated but entirely similar the through-hole 230 of the damping element 23), for example coaxial to the grinding wheel 20.

The auxiliary damping element 27 comprises a first face 271 (substantially planar or concave) facing towards the abrasive front face 202 of the annular body 200 and an opposite (and parallel) second face 272 (substantially planar or convex), which for example faces towards the first face 231 of the damping element 23.

The resilient yielding material the auxiliary damping element 27 is made of is, for example, rubber.

The rubber is preferably a natural rubber, polyurethane rubber, EPDM or nitrile rubber (NBR).

The resilient yielding material advantageously has a hardness comprised between 10 and 200 Shore.

For example, the first face 271 and/or the second face 272 (and/or the external perimeter edge thereof) of the auxiliary damping element 27 can be treated or clad with an appropriate primer for promoting the adhesion.

The thickness, namely the axial dimension, of the auxiliary damping element 27 can be smaller than or equal to the thickness of the annular body 200, i.e. the overall thickness of the grinding wheel 20, for example smaller than or equal to the thickness of the layer of abrasive mixture 21 in which it is incorporated, preferably but not limitedly the thickness of the auxiliary damping element 27 is comprised between 0.2 and 3 mm, preferably equal to 1 mm.

For example, the thickness of the auxiliary damping element 27 can be equal to the thickness of the damping element 23 (or smaller or larger thereof according to needs).

The auxiliary damping element 27 has an internal diameter, i.e. the diameter of the central through-hole, substantially equal to (or a little bigger than) the internal diameter of the annular body 200, i.e. the diameter of the mounting hole 201.

Again, the auxiliary damping element 27 has an external diameter substantially smaller than or equal to 0.7 times the external diameter of the annular body 200, preferably less than or equal to 0.5 times the external diameter of the annular body 200.

The auxiliary damping element 27 preferably has an external diameter substantially larger than 30 mm.

For instance, the external diameter of the auxiliary damping element 27 can be equal to the external diameter of the damping element 23 (or larger or smaller thereof according to needs).

The auxiliary damping element 27 is axially interposed between the front face 202 of the annular body 200 of the grinding wheel 20 and the first face 231 of the damping element 23.

For instance, in an embodiment, the auxiliary damping element 27 might be axially separated from the damping element 23 (i.e. the first face 231 of the damping element 23 is at a determined non-nil distance from the second face 272 of the auxiliary damping element 27) by interposing one or more layers of abrasive mixture 21 and/or one or more reinforcing nets 22.

The first face 271 of the auxiliary damping element 27 can be advantageously substantially free (flush with the front face 202 of the grinding wheel 20) and defines (or constitutes) at least a portion of the front face 202 of the annular body 200.

Alternatively, the first face 271 might be arranged below the surface of the front face 202 of the annular body 200 or be partly clad (only) by one of the reinforcing nets 22.

The second face 272 of the auxiliary damping element 27 is fixed to the layer of abrasive mixture 21, for example to the first face 211 thereof.

In practice, the front face 202 of the annular body 200 adheres to the whole surface of the second face 272 of the auxiliary damping element 27.

It is further possible for the grinding wheel 20 to comprise a plurality of auxiliary damping elements 27, for example coaxial, parallel and separated from one another by a respective plurality of abrasive mixture 21 and/or reinforcing nets 22. It is further possible that the auxiliary damping element 27 may be in contact with the damping element 23 and/or the auxiliary damping elements 27 of the plurality of auxiliary damping elements 27 may be (all or some) in reciprocal contact with one another.

Figure 14:
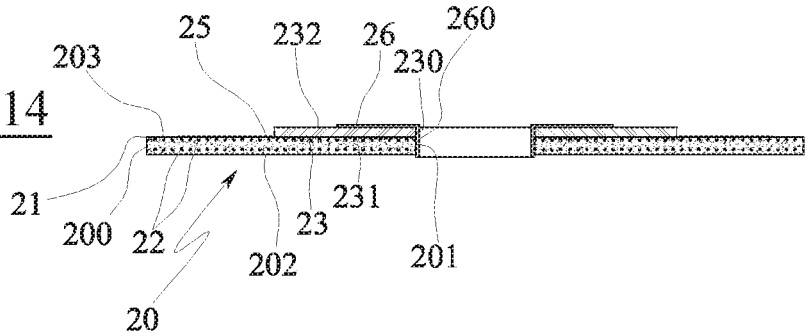
FIG. 14 Is a section view of a further alternative embodiment of an abrasive grinding wheel (flat) according to the invention.

In a further embodiment of the grinding wheel 20 shown in FIG. 14, the damping element 23, in particular the first face 231 thereof, is fixed to the first face 211 of the layer of abrasive mixture 21.

For instance, the first face 231 of the damping element 23 is glued (hot glued or cold glued) to the first face 211 of the layer of abrasive mixture 21, for instance by means of an adhesive layer.

The damping element 23 has, also in this embodiment, an annular shape and comprises a through-hole 230 (for example circular), for example substantially central and coaxial to the grinding wheel 20.

Again, the damping element 23 has an external diameter substantially less than 0.7 times the external diameter of the annular body 200, preferably less than or equal to 0.5 times the external diameter of the annular body 200.

In this way, the damping element 23 occupies only an inner annulus of the first face 211 of the layer of abrasive mixture 21 exposing an outer annulus of the same first face 211.

In this exemplary embodiment, the first face 211 of the layer of abrasive mixture 21 does not include step-shaped surfaces, but the first face 211 is substantially flat (when the grinding wheel is of flat type) or have a convex surface with rounded edges (when the grinding wheel is of depressed centre type).

By way of an example, the damper element 23 may be directly fixed to the layer of abrasive mixture 21 (as shown in FIG. 14), namely in such a way the first face 231 of the damper element 23 contacts (the inner annulus of) the first face 211 of the layer of abrasive mixture 21; by way of an alternative example, an annular portion of the label 25 and/or the washer 26 may be interposed between the damper element 23 and the layer of abrasive mixture 21, namely between the first face 231 of the damper element 23 and the first face 211 of the layer of abrasive mixture 21.

In this embodiment of the invention, the rear face 203 of the annular body 200 of the grinding wheel 20 is constituted by:

- the second face 232 of the damper element 23 (possibly partly or fully covered by the label 25 and/or the washer 26 where required),
- the first face 211 of the layer of abrasive mixture 21, namely the outer annulus thereof (possibly partly or fully covered by the label 25), and
- an outer (substantially cylindrical) skirt of the damper element 23 (possibly partly or fully covered by the label 25), namely the outer wall of the damper element 23 in the total axial thickness thereof which configures a kind of a riser of a step between the second face 232 of the damper element 23 and the first face 211 of the layer of abrasive mixture 21.

For instance, this embodiment of the grinding wheel 20, shown in FIG. 14, may be manufactured starting from a grinding wheel already solidified (by means of firing of the layers of abrasive mixture) to which is subsequently fixable, by gluing, the damper element 23, for instance by gluing (directly or indirectly) the first face 231 of the damper element 23 to the first face 211 of the layer of abrasive mixture 21.

In the light of the foregoing, the forming method of a grinding wheel 20 as described in the foregoing (with particular reference to FIGS. 1-13) includes the following steps.

Initially, for example, the washer 26 is inserted in the forming cavity 112, so that it fits on the centring pin 113 and goes to rest on the bottom wall 111 (for example the peripheral portion thereof), with the central hollow shank 260 rising from the bottom wall.

Thereafter, where appropriate, the label 25 is placed on the bottom wall 111 and/or on the washer 26.

At the same time (for example whether they are pre-glued or pre-flanked) or subsequently, the damping element 23 is inserted in the forming cavity 112, for example resting on the bottom wall 111 (directly or with an interposing of the label 25), with the second face thereof facing towards the bottom wall 111 (and resting on at least a portion thereof).

The damping element 23 is also fit on the centring pin 113, so that it is substantially coaxial to the forming cavity 112.

Following the insertion of the damping element 23, a layer of abrasive mixture 21 is deposited internally of the forming cavity 112, for example the rear layer (or sub-surface layer) thereof, so as to completely cover the damping element 23 and fill (to a predetermined thickness) the forming cavity 112.

A reinforcing net 22 is then laid on the layer of abrasive mixture 21 (i.e. on the rear layer or the sub-surface layer thereof) internally of the forming cavity 112.

The reinforcing net 22 is also fit on the centring pin 113 so that it is substantially coaxial to the forming cavity 112.

Once the reinforcing net 22 has been deposited, a quantity of abrasive mixture is deposited (in a depositing station of the abrasive mixture) internally of the forming cavity 112 so as to define a surface layer of the abrasive mixture layer 21 which incorporates the reinforcing net 22.

In practice, the quantity of abrasive mixture which forms the abrasive mixture layer 21 fills the forming cavity 112 for an axial thickness which passes beyond the lie plane of the reinforcing net 22, so that the reinforcing net 22 is completely incorporated in the layer of abrasive mixture 21.

If the plant and forming method of the grinding wheel 20 include a single depositing station of abrasive mixture, i.e. the grinding wheel 20 has a single layer of abrasive mixture 21, the damping element 23, the reinforcing net 22 and the layer of abrasive mixture 21 deposited in the forming cavity 112 are pressed so as to obtain the grinding wheel 20 (unfired semi-finished workpiece) of the desired shape (flat or with a depressed centre).

The pressing is done by action of the reciprocal nearing between the punch 12 and the bottom wall 111.

Lastly, the so formed grinding wheel 20 is subjected to a heat treatment of firing, for example obtained in suitable polymerising kilns, wherein the polymerisation of the bonding resin is completed, so that the polymerized bonding resin stably solidifies and retains the abrasive mixture which constitutes the grinding wheel itself (i.e. the disc-shaped body it is constituted by).

In practice, the grinding wheel 20 is subjected to a heat cycle which includes to insert the grinding wheel 20 in a kiln at a temperature substantially comprised between 120° and 220° C., for a time substantially comprised between 1 and 50 hours, or can be fired in situ into the die 10, if the die 10 is of the heatable type.

If, whereas, the method and the forming plant include two, three or more depositing stations of abrasive mixture, i.e. the finished grinding wheel 20 has a plurality of superimposed layers of abrasive mixture, before subjecting the grinding wheel 20 to the pressing and firing steps, further reinforcing nets 22 and further layers of abrasive mixture are inserted into the forming cavity 112, so that these further layers will form (once superposed) the layer of abrasive mixture 21 and the last of which will constitute the surface layer which defines the front face 202 of the annular body 200 constituting the grinding wheel 20.

The invention as it is conceived is susceptible to numerous modifications, all falling within the scope of the inventive concept.

Further, all the details can be replaced with other technically-equivalent elements. In practice the materials used, as well as the contingent shapes and dimensions, can be any according to requirements, without forsaking the scope of protection of the following claims.

The invention claimed is:

1. A grinding wheel comprising:

an annular body defining an abrasive front face at least partly made of a layer of an abrasive mixture and an opposite rear face, an annular damping element made of a resilient yielding material and fixed to the annular body, wherein the damping element comprises a first face facing towards the abrasive front face and an opposite free second face which defines at least a portion of the rear face of the annular body, and wherein the damping element has an external diameter substantially smaller than or equal to 0.7 times an external diameter of the annular body.

2. The grinding wheel of claim 1, wherein the resilient yielding material is rubber.

3. The grinding wheel of claim 2, wherein the resilient yielding material is a nitrile rubber.

4. The grinding wheel of claim 1, wherein the resilient yielding material has an hardness comprised between 10 and 200 Shore.

5. The grinding wheel of claim 1, wherein at least a backing net is fixed to the second face of the damping element.

6. The grinding wheel of claim 1, wherein at least a reinforcing net is incorporated in the layer of abrasive mixture.

7. The grinding wheel of claim 1, wherein the damping element has an external diameter that is substantially larger than 30 mm.

8. The grinding wheel of claim 1, wherein the damping element (23) has an external diameter substantially smaller than or equal to 0.5 times the external diameter of the annular body (200).

9. The grinding wheel of claim 1, wherein the damping element has an internal diameter that is substantially equal to an internal diameter of the annular body.

10. The grinding wheel of claim 1, comprising at least an auxiliary damping element having an annular shape and coaxially fixed to the annular body, wherein the auxiliary damping element is axially interposed between the front face of the annular body and the first face of the damping element.

* * * * *